US006827593B2

(12) United States Patent
Shinozaki et al.

(10) Patent No.: US 6,827,593 B2
(45) Date of Patent: Dec. 7, 2004

(54) LEVER-TYPE CONNECTOR

(75) Inventors: Tetsuya Shinozaki, Yokkaichi (JP); Keigo Atsumi, Yokkaichi (JP); Masanori Wakui, Toyota (JP)

(73) Assignee: Sumitomo Wiring Systems, Ltd., Yokkaichi (JP)

( * ) Notice: Subject to any disclaimer, the term of this patent is extended or adjusted under 35 U.S.C. 154(b) by 0 days.

(21) Appl. No.: 10/375,742

(22) Filed: Feb. 26, 2003

(65) Prior Publication Data

US 2003/0162426 A1 Aug. 28, 2003

(30) Foreign Application Priority Data

Feb. 26, 2002 (JP) ..... 2002-049382

(51) Int. Cl.[7] ..... H01R 13/62
(52) U.S. Cl. ..... 439/157
(58) Field of Search ..... 439/157, 160, 439/152, 153, 159, 372, 350, 352, 353

(56) References Cited

U.S. PATENT DOCUMENTS 4,875,873 A * 10/1989 Ishizuka et al. ..... 439/372
5,171,156 A * 12/1992 Nagasaka et al. ..... 439/157
5,201,665 A * 4/1993 McCardell, Jr. et al. .... 439/157
5,569,040 A 10/1996 Sumida
5,790,373 A * 8/1998 Kim et al. ..... 439/160
5,924,880 A * 7/1999 Watanabe et al. ..... 439/157
5,938,458 A * 8/1999 Krehbiel et al. ..... 439/157
6,293,813 B1 9/2001 Johnston et al.
6,354,164 B1 * 3/2002 Megason et al. ..... 439/157
6,544,053 B2 * 4/2003 Hahn et al. ..... 439/157
6,547,574 B2 * 4/2003 Sasaki et al. ..... 439/157
6,549,424 B1 * 4/2003 Beseth et al. ..... 439/157

* cited by examiner

*Primary Examiner*—P. Austin Bradley
*Assistant Examiner*—Felix O. Figueroa
(74) *Attorney, Agent, or Firm*—Gerald E. Hespos; Anthony J. Casella

(57) ABSTRACT

A lever-type connector (10) has a frame-shaped holder (11) for accommodating auxiliary connectors (24). A lever (40) is mounted on the holder (11) and is adapted to connect the lever-type connector (10) and a male connector (50) by cam action effected as the lever (40) is rotated. The lever (40) extends along only one wall surface of the holder (11). Thus, wires (27) and the lever (40) are unlikely to interfere with each other. Further, the lever (40) is accommodated in a recess (16) of the holder (11) and is held from opposite sides along a direction of the rotational axis. Thus, the lever (40) will not deform along the direction of the rotational axis and will not detach from the holder (11).

9 Claims, 13 Drawing Sheets

LEVER-TYPE CONNECTOR

BACKGROUND OF THE INVENTION

1. Field of the Invention

The invention relates to a lever-type connector.

2. Description of the Related Art

A split connector of a wiring harness has auxiliary connectors mounted in a frame-shaped holder so that the auxiliary connectors can be connected with a mating connector at once. The connector has a large number of contacts. Accordingly, connection resistance increases due to friction between terminals.

U.S. Pat. No. 5,569,040 discloses a connector that uses the cam action of a lever to reduce the connecting force. The connector has a holder for accommodating the auxiliary connectors, and supporting shafts project from left and right sides of the holder. The connector also has a gate-shaped lever with two cam plates and an operable portion that connects the cam plates. The cam plates are mounted rotatably on the supporting shafts of the holder and have cam grooves that engage cam pins of a mating connector. The lever then is rotated and the cam action of the cam grooves and the cam pins pulls the connectors toward one another.

The above-described connector has a reduced degree of design freedom due to interference of wires drawn out from the auxiliary connectors and the lever crossing over the holder. To avoid the interference of the wires and the holder, a wire draw-out direction or a lever rotatable range is subject to restriction. This often requires a larger connector.

The invention was developed in view of the above problem and an object thereof is to provide a lever-type connector with an improved degree of in freedom.

SUMMARY OF THE INVENTION

The invention relates to a lever-type connector with auxiliary connectors that accommodate terminal fittings. The connector has a holder for the auxiliary connectors, and the holder preferably is in the shape of a frame. A lever is mounted rotatably on the holder and connects the lever-type connector and a mating connector by cam action effected between the two connectors as the lever is rotated. The lever extends along only an outer wall surface of the holder. Accordingly, interference is unlikely between the lever and wires drawn out from the auxiliary connectors. Thus, a draw-out direction of the wires and a rotatable range of the lever are less restricted and the connector can be smaller.

The holder preferably has an accommodating recess to accommodate the lever and holds the lever from substantially opposite sides along the rotational axis of the lever. Accordingly, the lever will not deform along the direction of the rotational axis and will not detach from the holder while connecting or disconnecting the lever-type connector or during transportation. The accommodating recess preferably is defined between an outer wall and an intermediate wall of the holder, and the lever is held between the outer wall and the intermediate wall with a small clearance.

The rotation or pivotal movement of the lever preferably is guided by rotation or pivotal guiding means on the holder and/or the lever.

The connector assembly preferably has a connection completing locking piece for locking the lever at a connection completing position.

The lever may comprise at least one resilient locking piece engageable with the holder to hold the lever at the initial position. The resilient locking piece is resiliently deformable at an angle to the rotational axis of the lever, and preferably is resiliently deformable along a plate surface of a cam plate of the lever.

Most preferably, the connection completing locking piece is deformable in a direction different than the direction of deformation of the resilient locking piece, and preferably in a direction of the rotational or pivotal axis of the lever.

These and other objects, features and advantages of the present invention will become more apparent upon reading of the following detailed description of preferred embodiments and accompanying drawings. It should be understood that even though embodiments are separately described, single features thereof may be combined to additional embodiments.

DETAILED DESCRIPTION OF THE PREFERRED EMBODIMENTS

Figure 1:
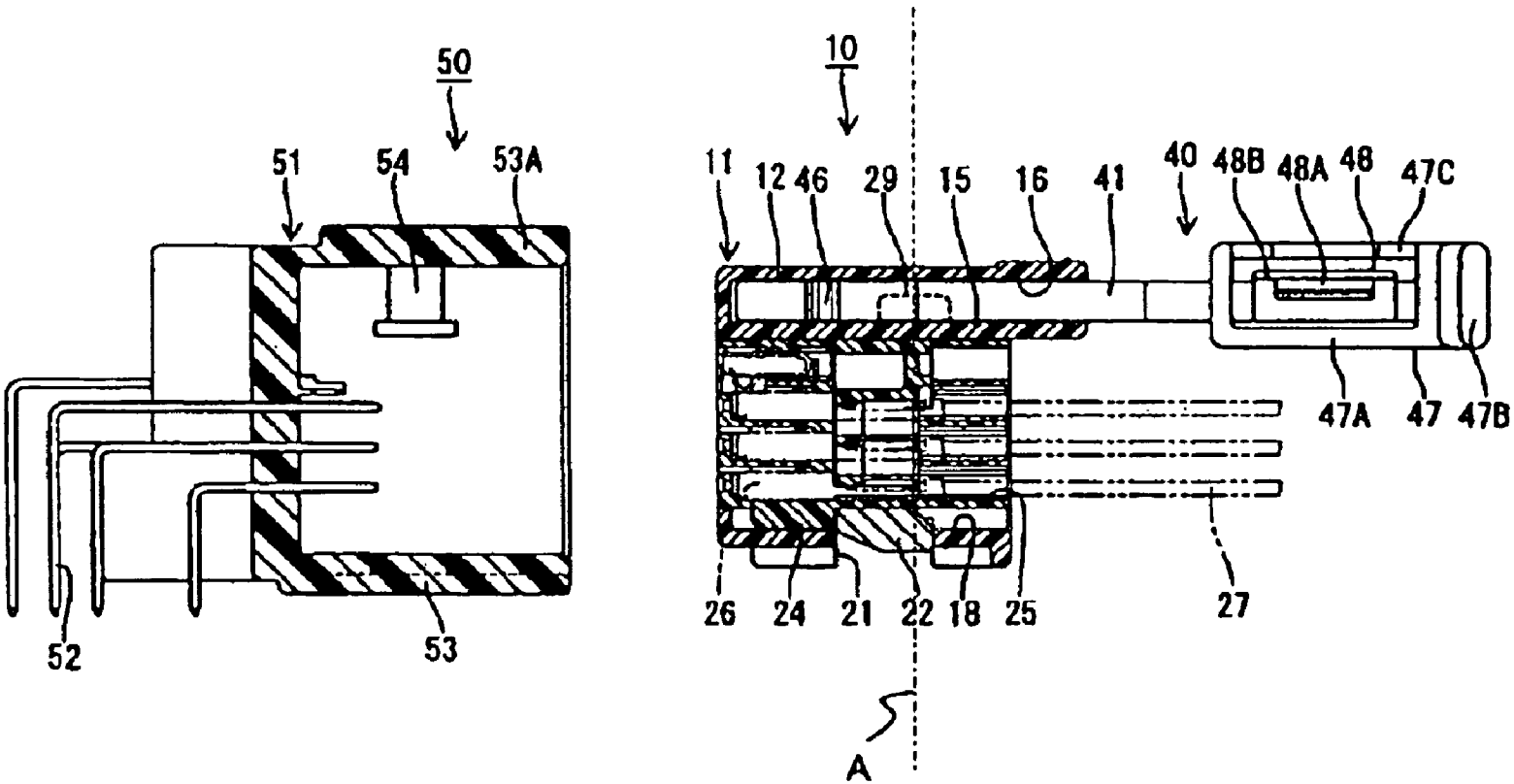
FIG. 1 is a longitudinal section of a lever-type connector and a male connector of the invention showing a state before the connectors are connected.
Figure 2:
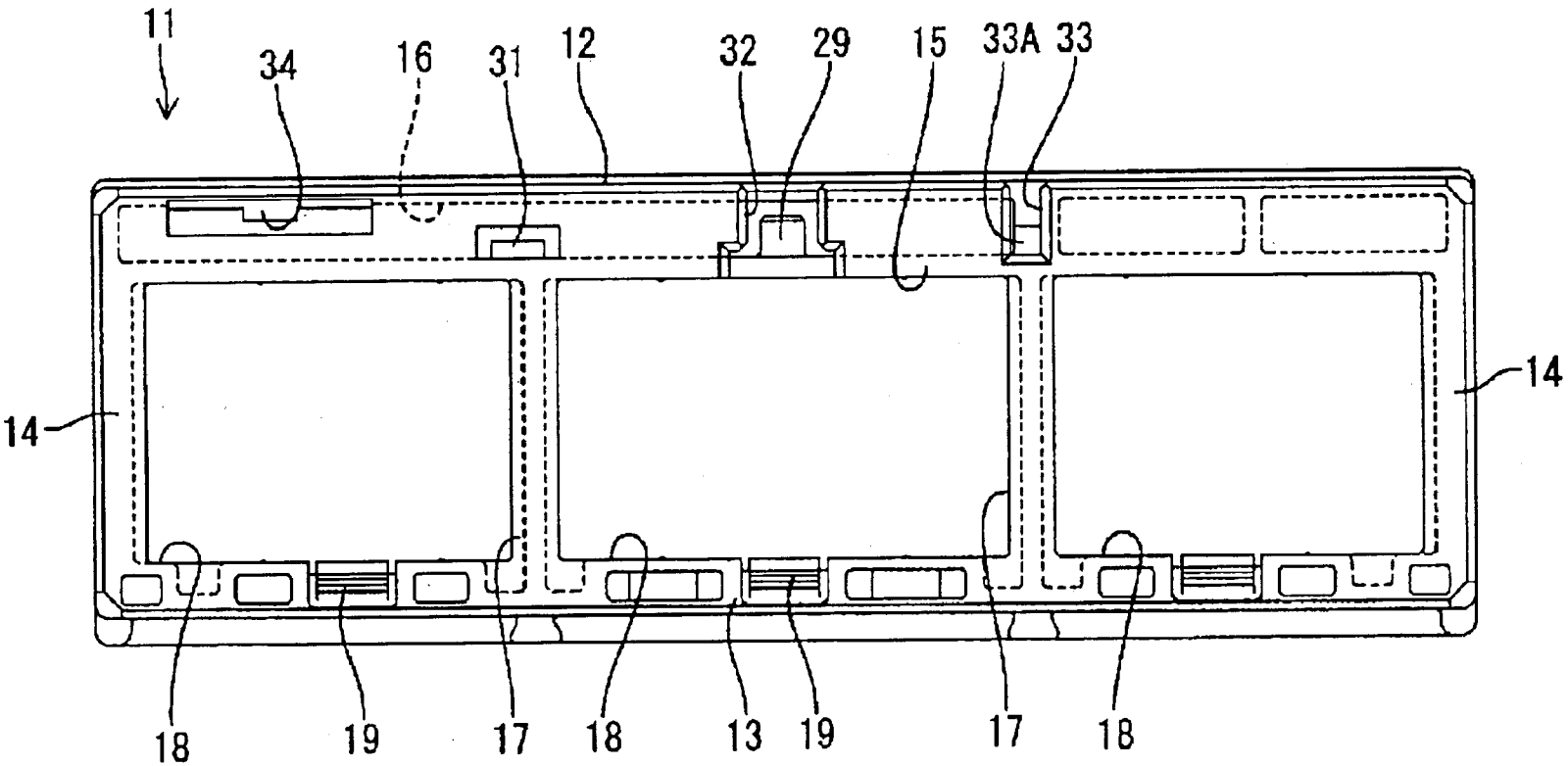
FIG. 2 is a front view of a holder.
Figure 3:
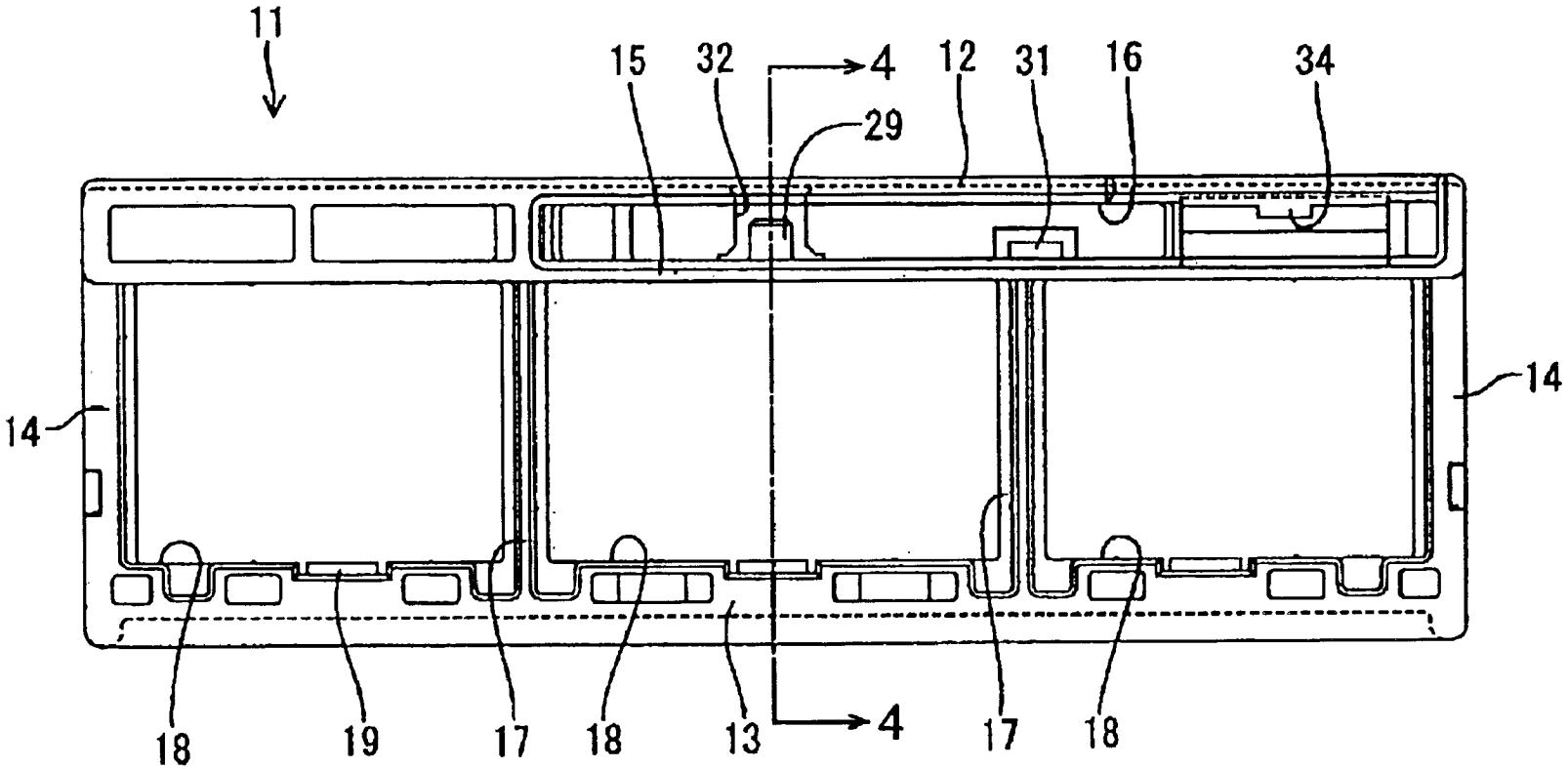
FIG. 3 is a rear view of the holder.
Figure 4:
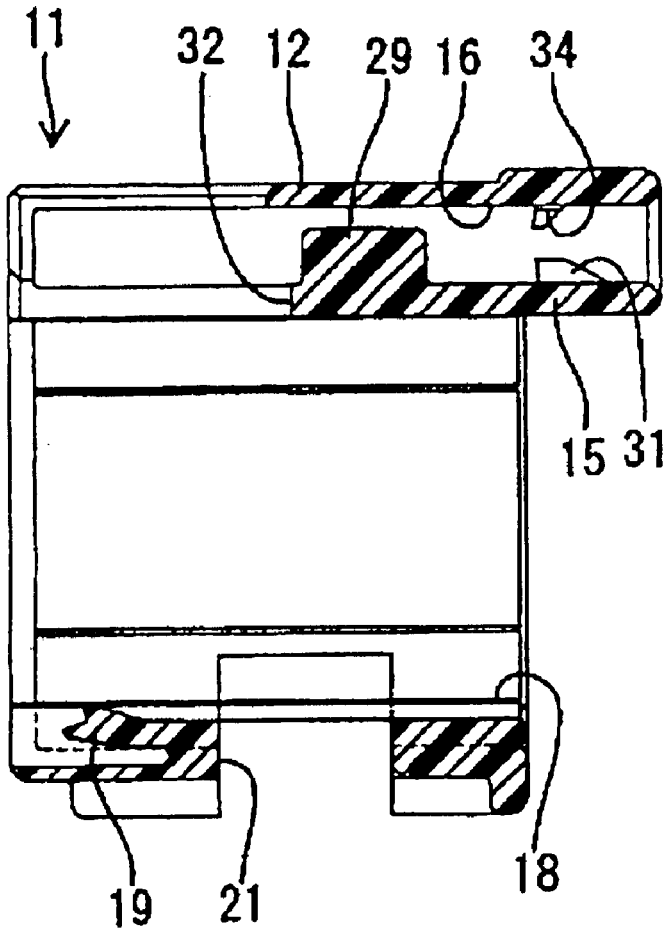
FIG. 4 is a section along 4—4 of FIG. 3.

A lever-type connector according to the invention is identified by the numeral 10 in FIG. 1. The connector 10 includes a holder 11, as shown most clearly in FIGS. 2 to 5. The holder 11 is formed e.g. of a synthetic resin and defines a wide rectangular frame that is hollow in forward and backward directions. More particularly, the holder 11 has an upper wall 12, a lower wall 13 and left and right side walls 14. A ceiling wall 15 is spaced inwardly from and substantially parallel to the upper wall 12 to define an accommodating recess 16 between the upper wall 12 and the ceiling wall 15. A support shaft 29 projects up from the ceiling wall 15 in the accommodating recess 16 of the holder 11. Two partition walls 17 extend between the ceiling wall 15 and the lower wall 13 to divide the inner space of the holder 11 into three transversely arranged mount spaces 18. The lower wall 13 is formed with resiliently deformable locks 19 that correspond to the respective mount spaces 18. Further, a recess 21 is formed in the lower wall 13 of the holder 11, and a retainer 22 is fitted into the recess 21 from below.

The connector 10 also includes auxiliary connectors 24. Each auxiliary connector 24 is formed e.g. of a synthetic resin and defines a substantially rectangular block (see FIG. 1). Cavities 25 are formed in each auxiliary connector 24, and a female terminal fitting 26 is inserted into each cavity 25 from behind. A wire 27 is secured to each female terminal fitting 26 and is drawn out through the rear end of the auxiliary connector 24. Each auxiliary connector 24 is fit into the corresponding mount space 18 of the holder 11 from behind. In a mounted state, the front and rear end surfaces of the auxiliary connectors 24 are substantially flush with the front and rear ends of the holder 11. The mounted auxiliary connectors 24 are doubly locked by the locks 19 and by a retainer 22 fit in a recess 21.

Figure 5:
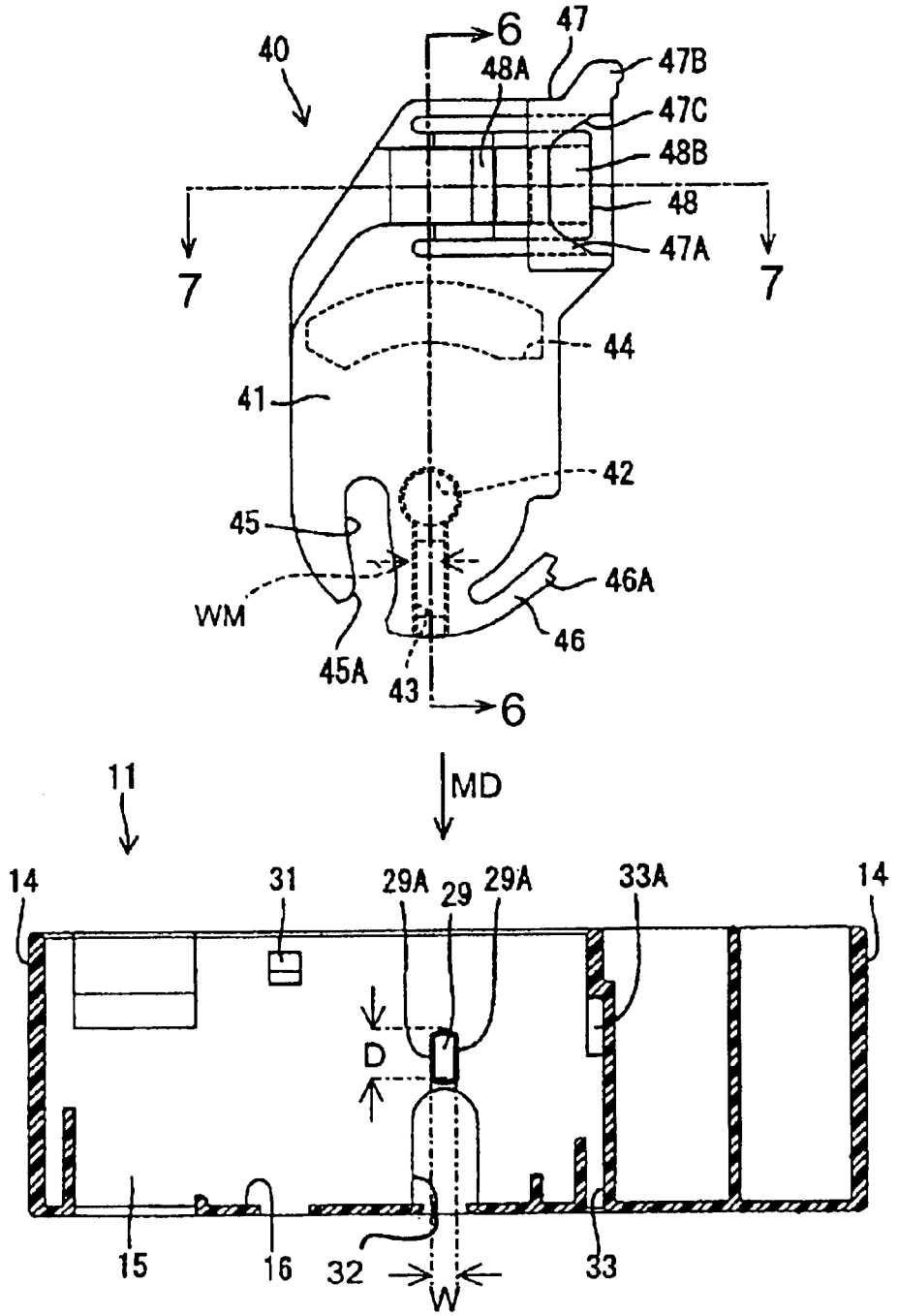
FIG. 5 is a horizontal section showing a state before a lever is mounted into the holder.
Figure 6:
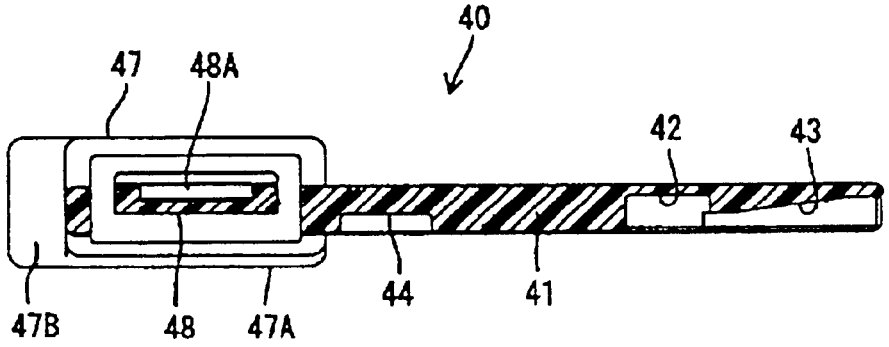
FIG. 6 is a section along 6—6 of FIG. 5.
Figure 7:
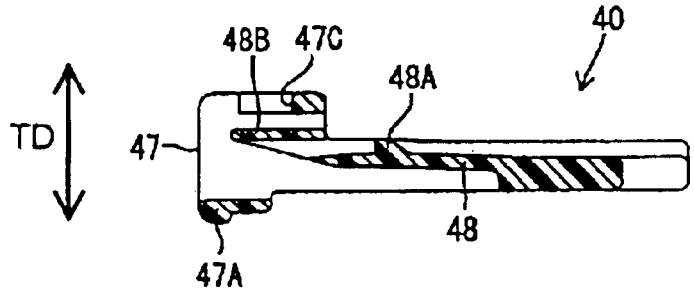
FIG. 7 is a section along 7—7 of FIG. 5.

The connector 10 further includes a synthetic resin lever 40 with a long narrow cam plate 41, as shown in FIGS. 5 to 7. The lever 40 is accommodated in the accommodating recess 16 so that the cam plate 41 is held between the upper wall 12 and the ceiling wall 15, while defining a small clearance to each of the upper and ceiling walls 12 and 15. Thus, the lever 40 extends substantially along the upper wall surface of the holder 11. A substantially round bearing hole 42 is formed in a lower surface of the cam plate 41 near one longitudinal end. The bearing hole 42 engages the support shaft 29 in the accommodating recess 16 of the holder 11 so that the lever 40 is substantially horizontally pivotable about the support shaft 29.

The support shaft 29 of the holder 11 is formed at its left and right sides with substantially parallel flats 29A. A mount groove 43 is formed on the lower surface of the cam plate 41 and extends in the longitudinal direction of the cam plate 41 from the bearing hole 42 to the outer edge of the cam plate 41 along a mounting direction MD of the lever 40 to the holder 11. The mount groove 43 guides the support shaft 29 to the bearing hole 42 when the lever 40 is mounted into the holder 11. The width WM of the mount groove 43 is slightly larger than the transverse dimension W between the flats 29A of the support shaft 29. Further, the depth of the mount groove 43 is smaller than the projecting distance of the support shaft 29 and becomes gradually smaller toward the bearing hole 42, thereby forming a step between the bottom surface of the bearing hole 42 and the bottom surface of the mount groove 43, as shown in FIG. 6.

Figure 13:
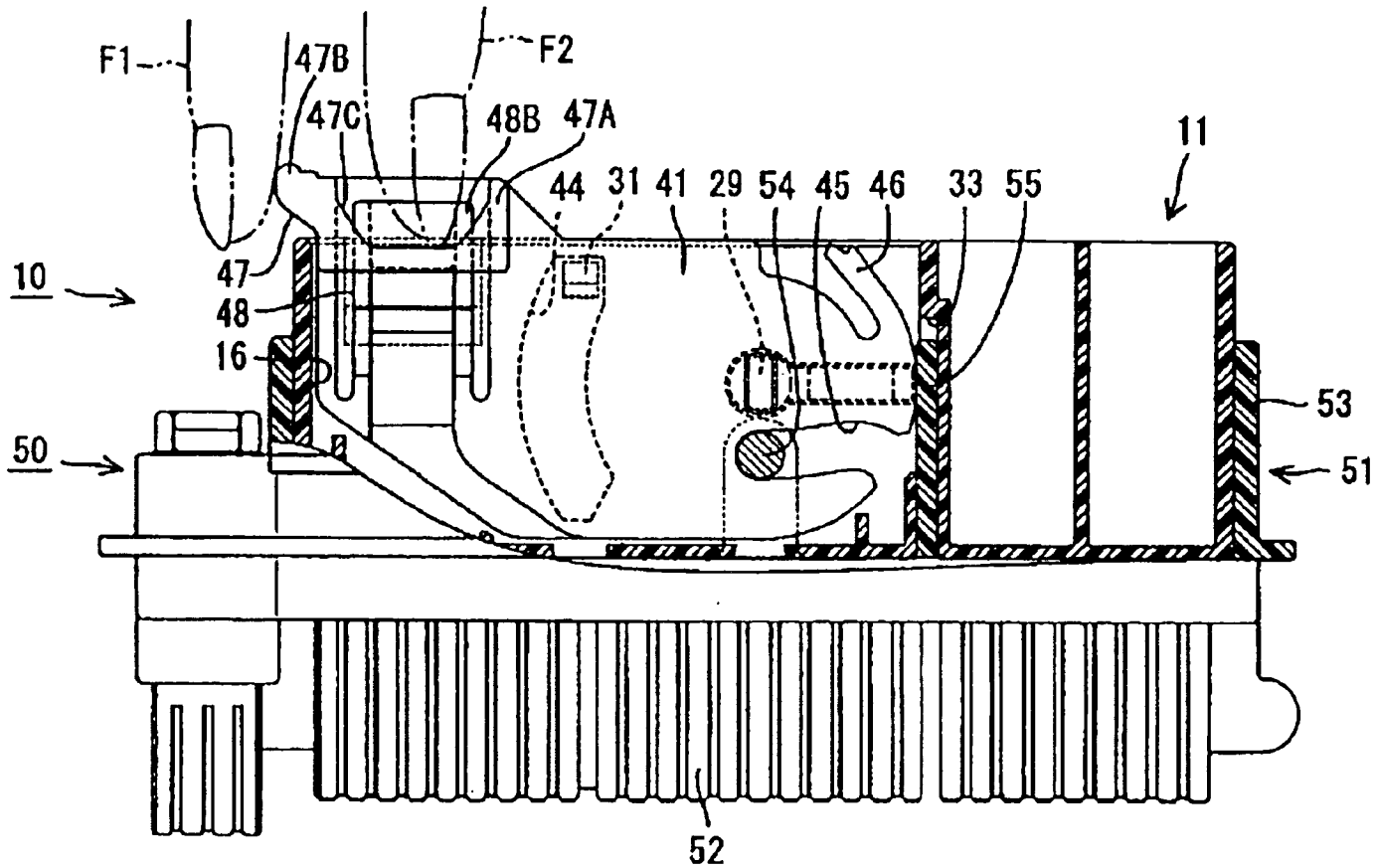
FIG. 13 is a horizontal section showing a state where the connection of the lever-type and male connectors is completed.

A rotation guiding groove 44 is formed in the lower surface of the cam plate 41 and substantially forms a fan with a center at the bearing hole 42. The rotation guiding groove 44 engages a stopper 31 on the upper surface of the ceiling wall 15 in the accommodating recess 16 of the holder 11. The stopper 31 is engageable with opposite ends of the rotation guiding groove 44 to define a pivotable range for the lever 40. Thus, the lever 40 is pivotable between an initial position shown in FIG. 10 and a connection completing position shown in FIG. 13. A cam groove 45 is formed in the cam plate 41 and has an opening 45A at the outer edge of the cam plate 41 and a closed end near the cam pin 54. The cam groove 45 is engageable with a cam pin 54 of the male connector 50. An escaping groove 32 is formed in the upper wall 12 and the ceiling wall 15 of the holder 11 in front of the supporting shaft 29 to permit entry of the cam pin 54 of the male connector 50. The opening 45A of the cam groove 45 aligns with the escaping groove 32 when the lever 40 is at the initial position. Thus, the cam groove 45 is ready for receiving the cam pin 54.

A resilient locking piece 46 is cantilevered at an end of the cam plate 41 and at a side of the cam plate 41 substantially opposite the cam groove 45. The resilient locking piece 46 extends substantially along the plane of the cam plate 41. The width (vertical dimension) of the resilient locking piece 46 equals the thickness of the cam plate 41, and the leading end of the locking piece 46 is deformable substantially in plane of the cam plate 41. A projection 46A projects out at the leading end of the resilient locking piece 46.

An escaping groove 33 is formed at a side of the accommodating recess 16 of the holder 11 and receives an unlocking rib 55 of the male connector 50. The escaping groove 33 extends back from the front surface of the holder 11, and a receiving portion 33A projects in the lower half of the escaping groove 33 at the rear end of the escaping groove 33. The projection 46A of the resilient locking piece 46 enters the escaping groove 33 when the lever 40 is at the initial position and the lower half of the projection 46A engages the receiving portion 33A. Thus, rotation of the lever 40 toward the connection completing position is prevented.

The lever 40 has an operable portion 47 at an end of the cam plate 41 substantially opposite the bearing hole 42 and at or near the rear surface side of the holder 11 when the lever 40 is at the connection completing position. The operable portion 47 has a substantially rectangular frame 47A that bulges out from the thickness direction of the cam plate 41 and a finger actuator 47B bulges out from the rectangular frame 47 in a direction away from the bearing hole 42. A resilient locking piece 48 also is at an end of the lever 40 substantially opposite the bearing hole 42. The resilient locking piece 48 is a flat plate that is cantilevered back substantially in the plane of the cam plate 41 when the lever 40 is at the connection completing position. However, the resilient locking piece 48 is resiliently deformable in its thickness direction TD, which is substantially the direction of the rotational axis A of the lever 40. A lock 48A projects from the upper surface of the resilient locking piece 48 and faces the upper wall 12. The lock 48A engages a claw 34 on the upper wall 12 of the holder 11 when the lever 40 is at the connection completing position. A planar finger pressing portion 48B is at the leading end of the resilient locking piece 48 for disengaging the lock 48A from the claw 34. The finger pressing portion 48B is inside the rectangular frame 47A, and a notch 47C is in the upper surface of the rectangular frame 47A for exposing the finger pressing portion 48B.

Figure 8:
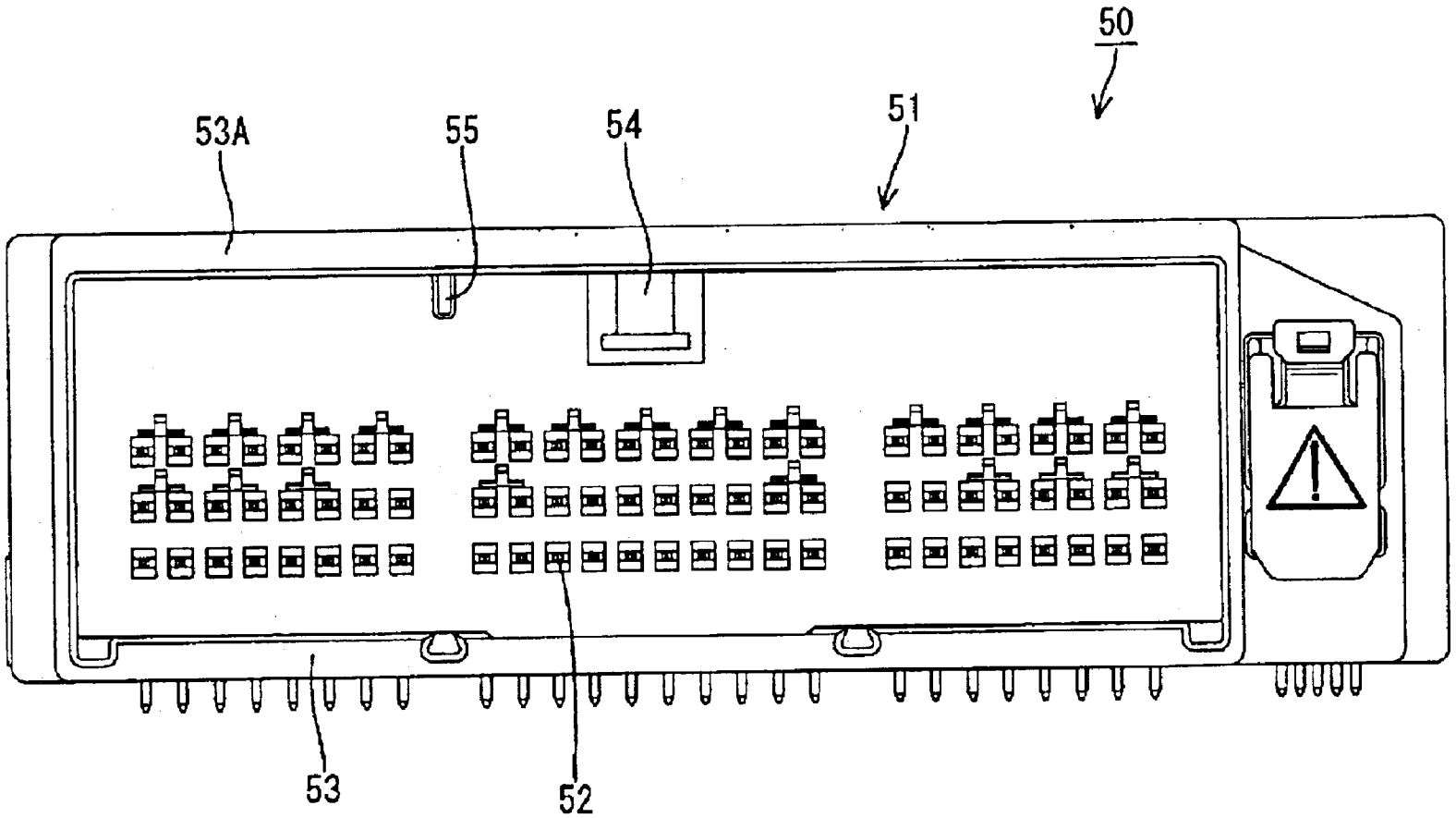
FIG. 8 is a front view of a male connector.
Figure 10:
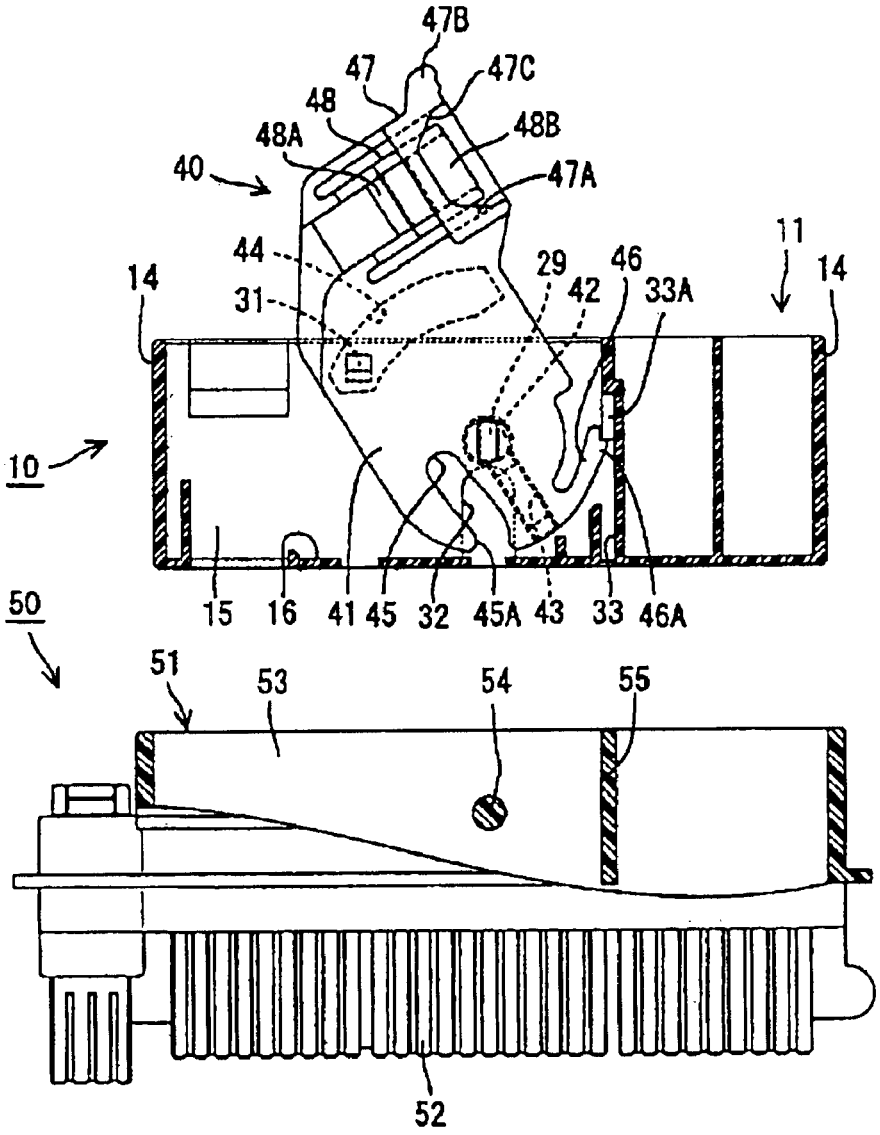
FIG. 10 is a horizontal section showing a state before the lever-type and male connectors are connected.

The connector 10 mates with a male connector 50, as shown in FIGS. 1, 8 and 10. The male connector 50 has a housing 51 formed e.g. of a synthetic resin and male terminal fittings 52 are secured in the housing 51. The housing 51 has a substantially rectangular receptacle 53 with an open front, and the terminal fittings 52 project forwardly into the receptacle 53. The holder 11 of the lever-type connector 10 is insertable into the receptacle 53, and the male and female terminal fittings 52 and 26 connect with each other when the connectors 10, 50 are connected properly.

The cylindrical cam pin 54 and the unlocking rib 55 project down into the inner space of the receptacle 53. The unlocking rib 55 extends from the front end of the receptacle 53 along forward and backward directions and enters the upper half of the escaping groove 33 when the male connector 50 is connected with the lever-type connector 10.

The connector is assembled by initially holding the lever 40 substantially parallel to the upper wall 12, as shown in FIG. 5. The cam plate 41 then is inserted into the accommodating recess 16 of the holder 11 so that the mount groove 43 aligns with the support shaft 29. The support shaft 29 then is pushed into the mount groove 43. As a result, the upper wall 12 and the ceiling wall 15 near the support shaft 29 deform slightly away from each other to permit passage of the lever 40. The depth of the mount groove 43 becomes gradually smaller toward the bearing hole 42 (see FIG. 6). Thus; the supporting shaft 29 can be pushed easily deeper into the mount groove 43. The upper wall 12 and the ceiling wall 15 restore resiliently to their original shapes as the support shaft 29 reaches the bearing hole 42. Accordingly, the bearing hole 42 engages the support shaft 29 (see FIG. 9).

Figure 9:
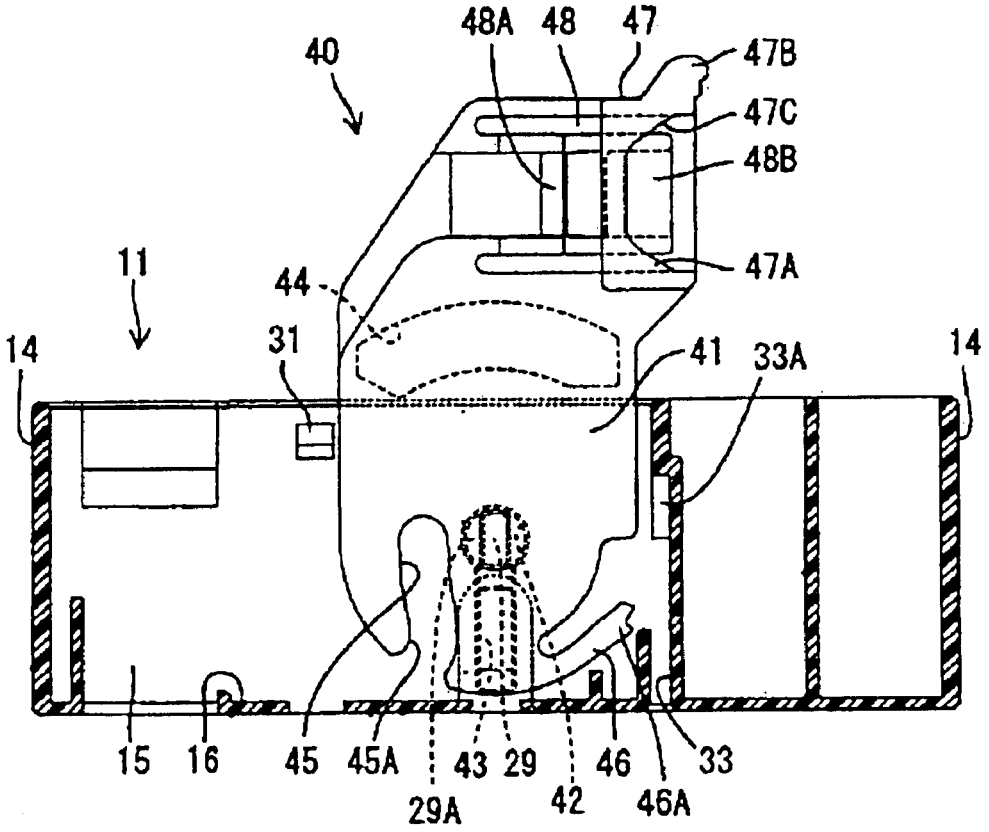
FIG. 9 is a horizontal section showing a state where the lever is inserted in the holder.

The lever 40 can be rotated, e.g. counterclockwise in the state shown in FIG. 9. Thus, the stopper 31 is pushed under the cam plate 41, and the upper wall 12 and the ceiling wall 15 near the stopper 31 are deformed slightly away from each other. The stopper 31 fits into the rotation guiding groove 44 when the lever 40 is rotated to the initial position shown in FIG. 10. Thus, the upper wall 12 and the ceiling wall 15 resiliently restore to their original shapes. Accordingly, the projection 46A of the resilient locking piece 46 enters the escaping groove 33 and engages the receiving portion 33A to prevent rotation of the lever 40 toward the connection completing position. Further, when the lever 40 is rotated in the state shown in FIG. 9, the orientation of the support shaft 29 deviates from that of the mount groove 43 in the bearing hole 42, and the lever 40 is locked to complete the mounting of the lever 40 into the holder 11.

Each auxiliary connector 24 is fit into the corresponding mount space 18 of the holder 11 as shown in FIG. 1, and the retainer 22 is brought into engagement with the auxiliary connectors 24 to lock the auxiliary connectors 24.

Figure 11:
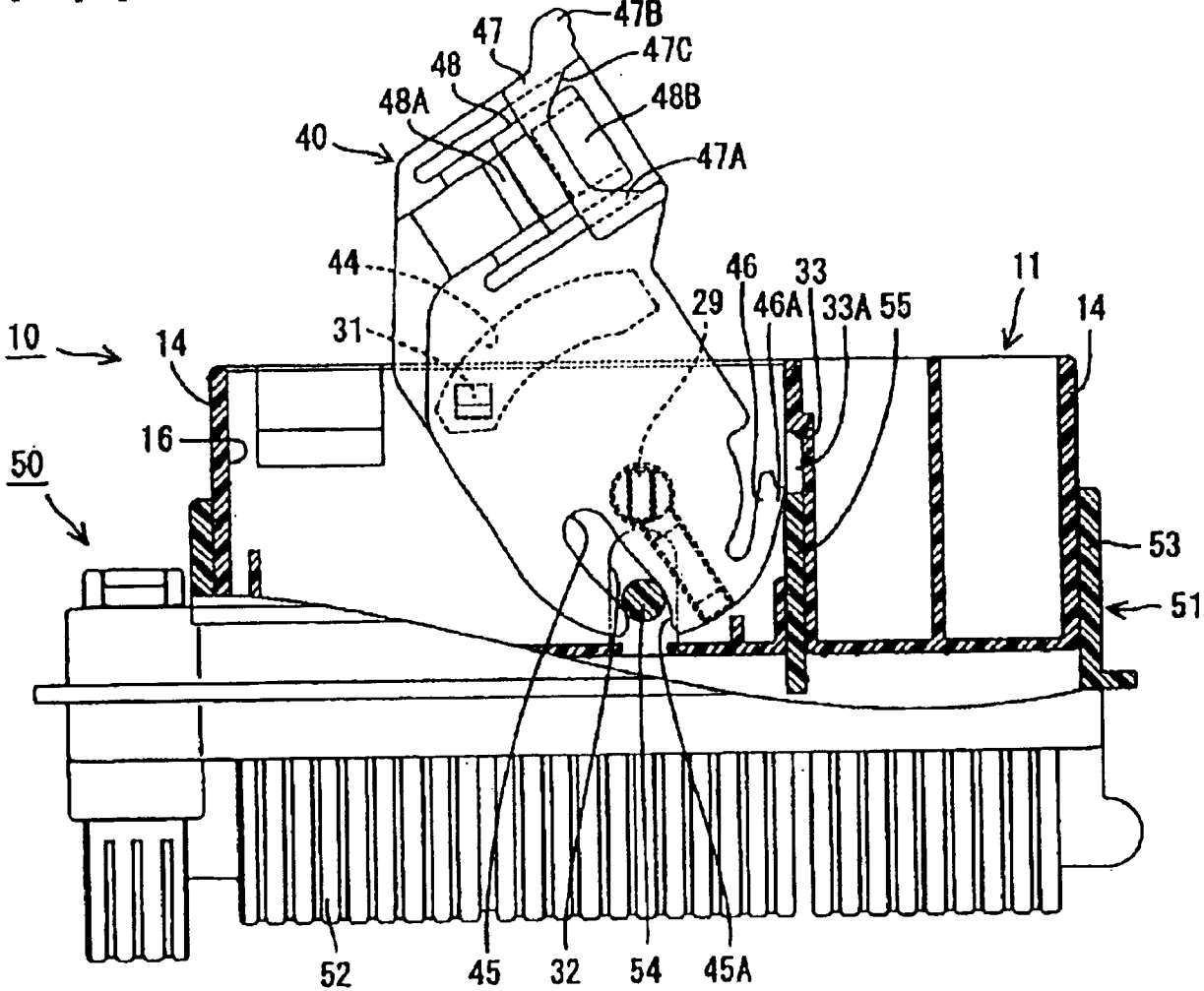
FIG. 11 is a horizontal section showing an initial stage of connection of the lever-type and male connectors.

Assembly proceeds by inserting the holder 11 of the lever-type connector 10 lightly into the receptacle 53 of the male connector 50. An attempt could be made to insert the lever-type connector 10 into the receptacle 53 upside down. However, the leading end of the unlocking rib 55 will contact the holder 11 to prevent insertion. The cam pin 54 fits into the opening 45A of the cam groove 45, as shown in FIG. 11, when the holder 11 is fit lightly into the receptacle 53 and the unlocking rib 55 contacts the projection 46A of the resilient locking piece 46. As a result, the resilient locking piece 46 deforms and disengages from the receiving portion 33A, and the lever 40 is permitted to rotate.

The operable portion 47 of the lever 40 then is pushed to rotate the lever 40 toward the connection completing position. This rotation generates a cam action between the cam groove 45 and the cam pin 54. As a result, the two connectors 10, 50 are pulled toward each other and the holder 11 is fit further into the receptacle 53. A force resulting from connecting resistance acts on the lever 40 during the connecting operation. However, the cam plate 41 is held in the accommodating recess 16 from the opposite sides along thickness direction TD. Thus, the cam plate 41 will not deform in the direction of the rotational axis A and the holder 11 will not disengage from the support shaft 29.

Figure 12:
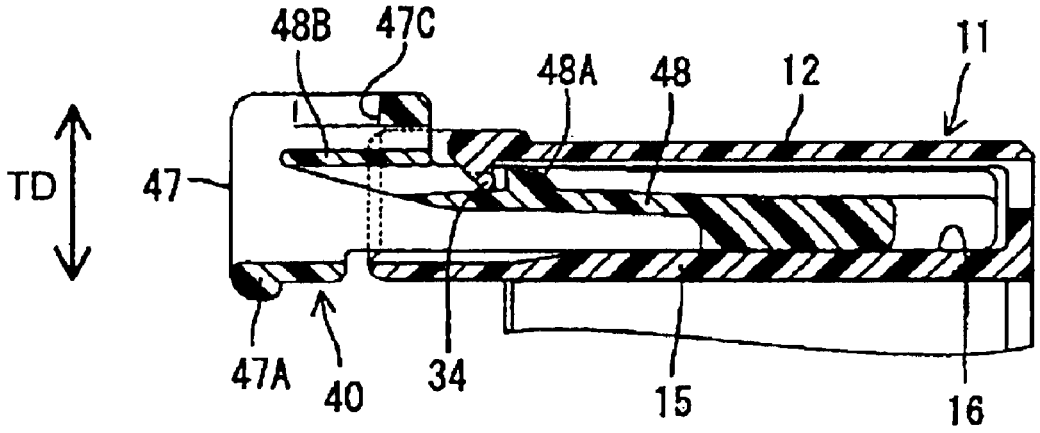
FIG. 12 is a partial enlarged longitudinal section showing a state where the lever is locked at a connection completing position.
Figure 14:
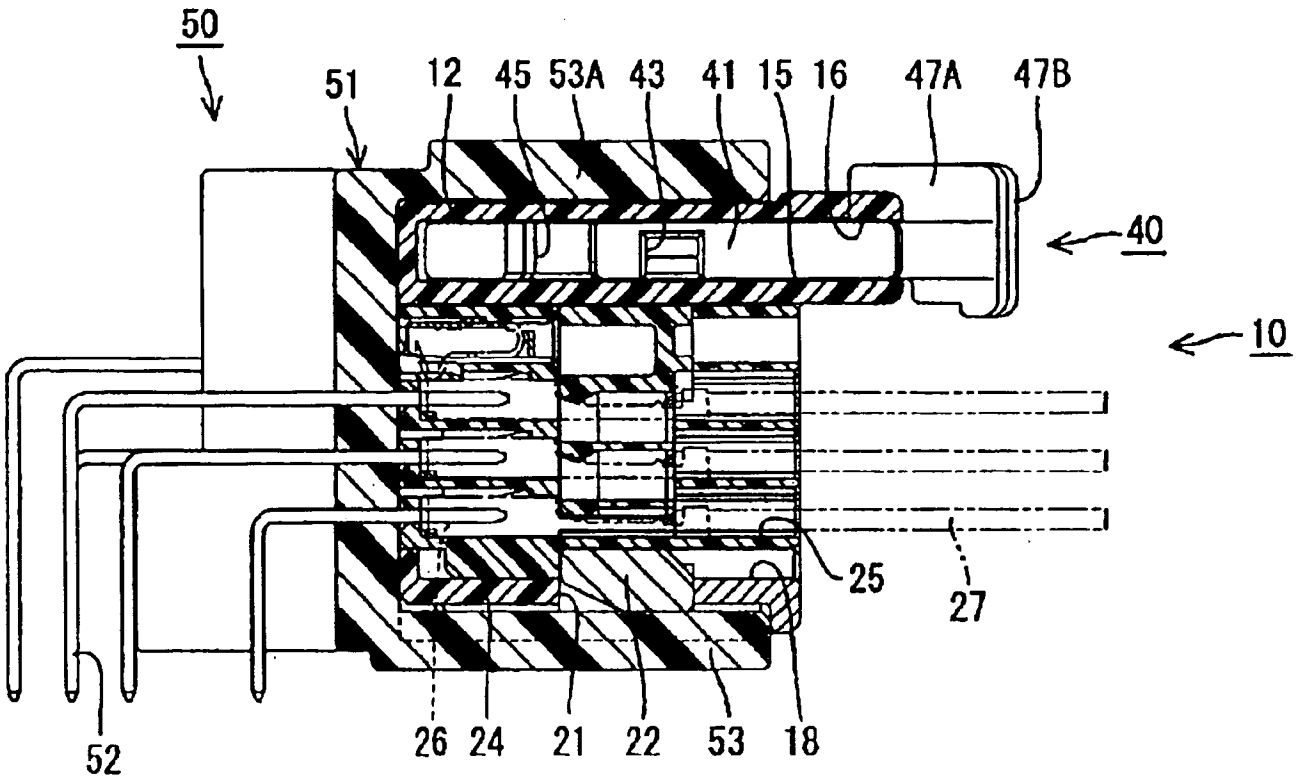
FIG. 14 is a longitudinal section showing a state where the connection of the lever-type and male connectors is completed.

The lock 48A of the resilient locking piece 48 contacts the claw 34 of the holder 11 when the lever 40 comes close to the connection completing position. Thus, the resilient locking piece 48 is deformed in a direction substantially normal to the plate surface of the cam plate 41. When the lever 40 reaches the connection completing position, the resilient locking piece 48 is restored resiliently towards its original shape and the lock 48A and the claw 34 engage to lock the lever 40 as shown in FIG. 12. As a result, the two connectors 10, 50 are connected properly (see FIGS. 13 and 14).

The two connectors 10, 50 are separated by placing a forefinger F1 on the finger placing portion 47B of the operable portion 47 and pushing the finger pressing portion 48B of the resilient locking piece 48 down by the tip of a thumb F2 to unlock the lever 40. The operable portion 47 then is pulled to rotate the lever 40 clockwise in FIG. 13. The cam pin 54 then is displaced along the cam groove 45 toward the opening 45A as the lever 40 is rotated. As a result, the two connectors 10, 50 are spaced away from each other. The cam pin 54 comes out of the cam groove 45 when the lever 40 reaches the initial position, and the two connectors 10, 50 are separated from each other.

As described above, the lever 40 extends along only one wall of the holder 11. Thus, the wires 27 drawn out from the auxiliary connectors 24 and the lever 40 are unlikely to interfere with each other. As a result, design freedoms are improved. Direction in which the wires 27 can be drawn out and a rotatable range of the lever 40 are less restricted, and the connectors 10, 50 can be smaller.

The lever is accommodated in the accommodating recess 16 of the holder and is held from opposite sides along the direction of the rotational axis A of the lever 40. Thus, the lever 40 will not deform in the direction of the rotational axis A and will not detach from the holder 11 while connecting and separating the connector 10 or during transport.

The invention is not limited to the above described and illustrated embodiment. For example, the following embodiment is also embraced by the technical scope of the present invention as defined in the claims. Beside the following embodiment, various changes can be made without departing from the scope and spirit of the present invention as defined in the claims.

The holder has the accommodating recess for accommodating the lever in the foregoing embodiment. However, the lever may be mounted to be exposed on one side surface of the holder without providing the holder with the accommodating recess.

What is claimed is:

1. A lever-type connector, comprising:

auxiliary connectors for receiving terminal fittings connectable with ends of wires;

a frame-shaped holder with opposite first and second outer walls, mount spaces defined in the holder substantially adjacent the second outer wall for accommodating the auxiliary connectors, an accommodating recess being defined in the holder between the first outer wall and the mount spaces; and a plate-shaped lever having a single cam plate rotatably mountable in the accommodating recess on the holder and held parallel to the first outer wall with a small clearance, the lever having an operable portion externally of the holder for receiving pushing forces to rotate the lever, the lever being adapted to connect the lever-type connector and a mating connector by cam action effected between the two connectors as the lever is rotated, whereby the single cam plate avoids in interference with wires drawn out from the auxiliary connectors.

2. The lever-type connector of claim 1, wherein the accommodating recess is configured for holding the lever from substantially opposite sides along a direction of a rotational axis of the lever.

3. The lever-type connector of claim 1, wherein rotation of the lever is guided by rotation guiding means on the holder and the lever.

4. The lever-type connector of claim 1, further comprising a connection completing resilient locking piece for locking the lever at a connection completing position.

5. A lever-type connector, comprising:

auxiliary connectors for receiving terminal fitting connectable with ends of wires;

a frame-shaped holder with opposite first and second outer walls, mount spaces defined in the holder substantially abjacent the second outer wall for accommodating the auxiliary connectors, an accommodating recess being defined in the holder between the first outer wall and the mount spaces; and a plate-shaped lever rotatably mounted in the accommodating recess on the holder and held parallel to the first outer wall with a small clearance, the lever being adapted to connect the lever-type connector and a mating connector by cam action effected between the two connectors as the lever is rotated, the lever further comprising a connection completing resilient locking pieces for locking the lever at a connection completing position and wherein the lever further comprises at least one resilient locking piece engageable with the holder for holding the lever at an initial position and resiliently deformable in a direction substantially normal along a plate surface of a cam plate of the lever.

6. A lever-type connector comprising;

auxiliary connectors for receiving terminal fitting connectable with ends of wires;

a holder for accommodating the auxiliary connectors;

a lever rotatably mountable on the holder and adapted to connect the lever-type connector and a mating connector by cam action effected between the two connectors as the lever is rotated, the lever extending along only one side of the holder, the lever comprising at least one resilient locking piece engageable with the holder for holding the lever at an initial position and resiliently deformable in a direction substantially normal to a rotational axis of the lever and substantially along a plate surface of a cam plate of the lever; and a connection completing resilient locking piece for locking the lever at a connection completing position, wherein the connection completing resilient locking piece is resiliently deformable in a direction substantially parallel to the rotational axis of the lever.

7. The lever-type connector of claim 6, wherein the resilient locking piece is resiliently deformable along a plate surface of a cam plate of the lever.

8. The lever-type connector of claim 6, wherein the holder is substantially frame-shaped.

9. The lever-type connector, comprising;

auxiliary connectors for receiving terminal fittings connectable with ends of wires;

a frame-shaped holder with opposite first and second outer walls and an intermediate wall substantially parallel to and spaced from the first outer wall, an accommodating recess defined between the first outer wall and the intermediate wall of the holder, mount spaces defined between the intermediate wall and the second outer wall for accommodating the auxiliary connectors, and a lever having only one cam plate rotatably mountable in the accommodating recess on the holder, the one cam plate of the lever being held between the first outer wall and the intermediate wall with a small clearance, the lever being adapted to connect the lever-type connector and a mating connector by a cam action effected between the two connectors as the lever is rotated, whereby the one cam plate avoids interference with wires drawn out from the auxiliary connectors.

* * * * *